United States Patent [19]

Steier

[11] 4,225,091

[45] Sep. 30, 1980

[54] METHOD OF AND APPARATUS FOR THE MILLING OF SOLIDS

[75] Inventor: Klaus Steier, Munich, Fed. Rep. of Germany

[73] Assignee: Babcock Krauss-Maffei Industrieanlagen GmbH, Munich, Fed. Rep. of Germany

[21] Appl. No.: 12,493

[22] Filed: Feb. 15, 1979

[30] Foreign Application Priority Data

Feb. 23, 1978 [DE] Fed. Rep. of Germany ..... 2807691

[51] Int. Cl.[3] ..... B02C 25/00

[52] U.S. Cl. ..... 241/24; 241/30; 241/34; 241/79; 241/186.3

[58] Field of Search ..... 241/33, 34, 36, 37, 241/97, 80, 186 R, 186.3, 30, 24, 79

[56] References Cited

U.S. PATENT DOCUMENTS

| | | | |
|---|---|---|---|
| 3,784,115 | 1/1974 | Krijger et al. | 241/34 X |
| 3,942,727 | 3/1976 | Fahlstrom et al. | 241/34 |

*Primary Examiner*—Mark Rosenbaum
*Attorney, Agent, or Firm*—Karl F. Ross

[57] ABSTRACT

A method of operating a milling installation to regulate the fineness of the milled product, in which the milled product emerges from the output side of a mill, e.g. a ball-type tube mill, and material to be milled is introduced at the opposite side of the mill. According to the invention, the mass output rate dm/dt or $\dot{m}$ of the product is continuously or discontinuously measured and this measurement is used to control the rate of mass output at the output side of the mill so that the output rate is held substantially constant. The invention is applicable to a through-flow (continuous open-circuit) mill in which a fresh starting material is continuously introduced into the mill and to the circulating system (continuous closed-circuit mill) in which the output of the mill is delivered to a classifier which separates the fine product from a coarse component which is recycled to the mill.

10 Claims, 5 Drawing Figures

METHOD OF AND APPARATUS FOR THE MILLING OF SOLIDS

FIELD OF THE INVENTION

The present invention relates to a method of and to an apparatus for the milling of solids. More particularly, the invention relates to a method of operating a mill and to a mill structure especially adapted to such operation. The invention also relates to a method of and to an apparatus for controlling the fineness of the product of a milling installation.

BACKGROUND OF THE INVENTION

It is known to provide a milling installation which employs a through-flow (continuous, open-circuit) mill, generally a tubular ball mill, having an inlet end for the material to be ground or comminuted and discharge end for the finished product, the interior of the mill being provided with balls or the like which, by abrasion, impact, compression and a combinations thereof, upon rotation of the tubular housing of the mill, cause size reduction of the material traversing the mill.

Reference will be made hereinafter to a circulating (continuous, closed-circuit) mill system and to a through-flow (single pass) milling system and it is of interest to review the distinctions between them.

In a single-pass continuous (open-circuit) milling system, the raw material is introduced at the inlet end to the mill and is maintained therein for a period (residence time) sufficient to give the final product fineness which is desired, the product being discharged at the outlet end.

In a circulating milling system, the product is a mixture of the desired fines and a recycled coarse component which must be remilled. The product from the discharge side of the mill is conveyed, e,g. by a trough, elevator, bucket conveyor or the like, to the classifier which separates the output mixture into the product fines and the coarse component. From the classifier (sifter) the coarse component is recycled to the inlet of the mill where it is combined with the raw material and reintroduced with the latter into the mill.

While we have referred to a tube-type ball mill above, it should be noted that the invention and the principles described are applicable to all types of mills in which the output rate is a function of the residence time of material in the mill. Such mills include oscillating, tumbling or vibratory mills and like systems.

In single-pass mills and circulating mills of the type described, significant fluctuations in the characteristics of the raw material, with constant milling conditions, result in a change in the fineness of the milled output or product.

If a constant product fineness is desired, in spite of these fluctuations, one modifies the rate at which the raw material or fresh material is introduced into the mill and, in the case of a circulatory milling installation, the classifier setting, i.e. the ratio between fine stream and the coarse stream.

For automatic control various systems have been proposed without being fully satisfactory.

A conventional control system measures the quantity ahead of and behind the sifter or classifier or determines the fineness of these streams and controls, upon a deviation one of these measured values from a set point value, the feed to the mill and partially the fineness setting if the classifier or sifter (see German patent document—Open Application—Offenlegungsschrift Nos. 1,507,483 and 1,507,490).

Other control systems of the prior art utilize the rate of operation of the bucket conveyor or elevator or the drive motor of the mill (see German patent document—Pat. No. 284,154 and German patent document—Open Application—Offenlegungsschrift—No. 1,763,432) to control the feed of material to the mill.

These prior-art control techniques have two distinct disadvantages:

A. The measurement and control parameters have different time functions. The response time is relatively great and is of the order of the residence time of the material in the mill.

B. The flow characteristics of the comminuted material amplifies the fluctuation of the fineness of the milled product with variations in the milling characteristics of the material. As the milled product becomes coarser, for example, because the raw material is less millable, the flowability of the product improves. With a constant discharge geometry of the mill, the increasing flowability results in an increased product discharge and a reduced residence time of the milled material in the mill. This, in turn, reduces the fineness of the product.

The two effects act counter to one another and fluctuations in the fineness are noticeable in all systems in which these effects are pronounced.

If efforts are made to obtain a constant fineness of the product stream, the classifier must be adjusted so as to reduce the introduction of the raw material to a more significant degree than would be ordinarily deemed necessary as a result of changes in the grindability (e.g. A.S.T. or D-408).

Mention can be made of still another control technique in which, upon an increase in the coarseness of the discharged product, a portion of this product, to increase the fineness, is returned to the mill inlet (see German patent document—printed application—Auslegeschrift No.—1,913,440). This system, however, also has the disadvantage that the response time between the detection of a deviation of the fineness from a set point value, through the adjustment of the recycler, to the correction of the fineness is relatively long and unsatisfactory.

OBJECTS OF THE INVENTION

It is the principal object of the present invention to provide a method of operating a continuous milling system (either a single-pass mill or a circulatory mill whereby the disadvantage of the earlier systems are avoided.

Another object of the invention is to provide an improved method of controlling the fineness of a milled product with a low response time and hence with high efficiency.

It is also an object of this invention to provide an improved apparatus for controlling the fineness of a milled product such that at most minor variations in the fineness of the product are observed with variations in the grindability of the starting material.

It is yet another object of the invention to provide a method of controlling fineness of a milled product, especially from a ball mill, in which minimal and brief variations, at most, in the fineness of the product are manifested with variation in the ability of the raw material to be milled.

SUMMARY OF THE INVENTION

These objects and others which will become apparent hereinafter are attained, in accordance with the present invention which primarily is a method of regulating the fineness of a finished product produced by a single-pass milling installation with a mill whose residence time is a function of the output rate, namely a tubular ball mill or the like, or a circulating milling installation utilizing such a ball mill, a size classifier downstream of the mill (e.g. sifter) and a conveyor between these devices (e.g. a bucket elevator or a trough) by controlling the product flow rate of the through-flow mill or the flow rate from the mill to the classifier.

According to the invention, the quantity (mass) of the milled product per unit time (dm/dt or $\dot{m}$) leaving the mill is continuously or discontinuously measured and control is effected corresponding to this measurement so that the product stream of the single-pass mill or the output stream to the classifier is held constant with time (constant flow rates or $dm/dt=\dot{m}=c$) or in the case of a circulating system so that downstream of the classifier a constant ratio between the coarse product flow rate and the finished (fine) product flow rate is obtained, the adjustment of the classifier at most being made to correct the effect of throughput variations upon the fineness of the fine product.

With the improved system of the afore-described type, the response time of the control circuit is reduced by comparison to systems which control the feed rate in the sense that the latter is maintained constant or is modified in response to the level within the mill. In addition, the effect of variations in the fineness of the product on the flow characteristics thereof, tending to amplify deviations in the fineness as discussed at point B above, are excluded from detrimental action upon the control.

In a closed circuit or circulatory system with a constant classifier setting, it is possible to hold the constant mass flow ratio M of the finished product $\dot{m}_{Fe}$=mass flow rate $dm_{Fe}/dt$ and the coarse product mass flow rate $\dot{m}_G=dm_G/dt$ $\dot{m}_G/\dot{m}_{Fe}$=constant=M with an increase in this ratio that mill throughput, i.e. the output mass flow $\dot{m}_A$ or $dm_A/dt$ is reduced and, inversely, upon a reduction of this ratio the output mass flow rate $\dot{m}_A$ is increased so that without expensive and time-consuming measurements of the fineness of the finished product directly, control is afforded to yield a constant specific surface for the product.

With very large fluctuations in the milling parameters, for example, the grindability and thus the output mass flow rate $\dot{m}_A$, the value of the latter can be used to correct the setting of the classifier to further modify the input to the continuous mill.

When one controls the output mass flow rate $\dot{m}_A$ to equal the input mass flow rate $\dot{m}_E$, i.e. both to the same value, the degree of filling of the mill can be maintained constant. This ensures that the mill will operate constantly with optimum parameters without the expensive measuring process heretofore required, such as frequency-filtered determinations of the noise level of the mill, radioactive measurements of the degree of filling of the mill or determinations of the total weight of the mill.

Naturally, methods of determining the fineness of the finished product or the operating of the mill (e.g. electric ear) can be coupled with the output control of the present invention to ensure that the output mass flow has a constant value and the other measured values or parameters can be used to control the fresh material feed. Of course both the output and the fresh material feed can be varied. The invention is also applicable to a multistage or compartment milling in which the output mass flow is used to control the through-flow from one to another compartment and to conform thereto.

The process of the present invention can, in principle, be carried out by the use of conventional devices. These devices can be used to increase the residence time in the mill and thus the fineness of the product and, conversely, to reduce the residence time in the mill and decrease the fineness of the product. They can be provided so that as to be effective after a halt in operation of the mill (see German Pat. No. 210,503 and German Pat. No. 240,049 and U.S. Pat. No. 1,787,897). They can be effective during a milling operation (for instance German Pat. No. 437,856) as well. In another system described in the German Open Application—Offenlegungsschrift No. 2,207,484, the discharge end of the tube is modified so that different quantities of the milled product can be led out of the mill. The conventional devices vary in degrees of filling of the mill and are not effective for continuous regulation of the milled product fineness, are relatively expensive and tend to become inoperative even after short periods of operation, especially when they are provided in the mill in addition to preexisting equipment.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
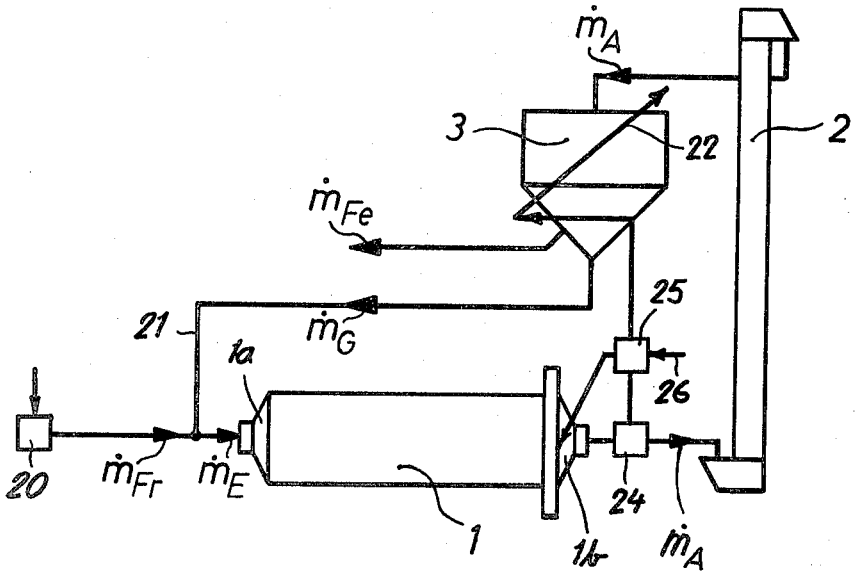
FIGS. 1 and 1*a* are two flow diagrams illustrating principles of the present invention as applied to a continuous closed-circuit milling installation provided with a classifier.
Figure 2:
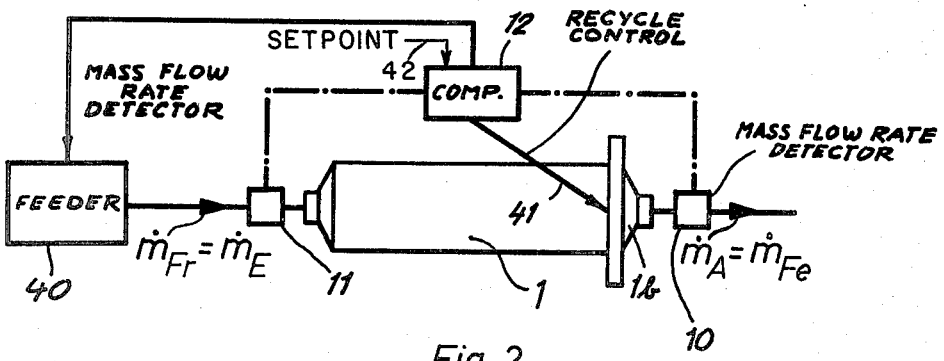
FIG. 2 is an illustration of the principle of the operation as applied to a continuous open-circuit single pass installation.
Figure 1A:
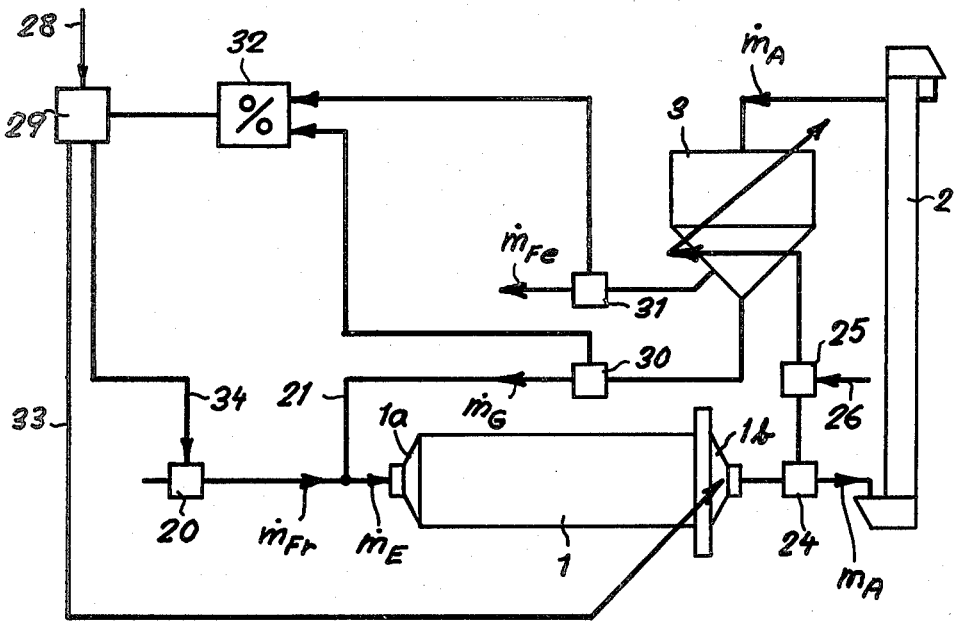

In FIGS. 1 and 1*a* and 2 I have shown a circulatory milling system using a ball mill of the tube type and a single pass milling system using a similar mill, respectively. For mills with which these system can be employed, reference is made to Perry's *Chemical Engineer's Handbook,* Mc Graw-Hill Book Company, New York, 1963, Chapter 8, pages 7 through 14 and 21 ff. (i.e. pages 8–7 to 8–14 and 8–21 ff.). This chapter also describes elevators, classifiers and material feeders which can be used for the purposes to be discussed below.

In FIG. 1, the ball-type tube mill 1, shown only diagrammatically, has an inlet end 1*a* and outlet 1*b*, the inlet end being fed with fresh material to be ground by a feeder 20 and with recycled coarse material via a line 21. The discharged product from the outlet 1*b* is fed to an elevator 2 from which it is supplied to a classifier 3 which is shown to be adjustable by the arrow 22. The control system of the present invention includes a mass flow rate detector 24 responding to the mass output rate $\dot{m}_A$ and providing an instantaneous measurement thereof, the measured signal being applied to a comparator 25 to which a set-point value is applied at 26 representing the grindability of the material. The output of the comparator 25 adjusts the mass output rate $\dot{m}_A$ to a constant value and can adjust also the ratio mentioned previously at the classifier.

Another use of the control system of the present invention is shown in FIG. 1*a*. This system should mainly be applied if the grindability of the material varies significantly. A pair of mass flow rate detectors 30 and 31 measure the instantaneous values of the mass flow rates $\dot{m}_{Fe}$ and $\dot{m}_G$ of the finished product and the recycled coarse fraction, respectively, and supply corresponding signals to a ratio former (divider) 32 which forms the aforementioned ratio $M=\dot{m}_G/\dot{m}_{Fe}$. A signal corresponding to the instantaneous value of this ratio M is delivered to a comparator 29 where it is compared with the set-point value 28 to produce signals which are applied via lines 33 and 34 to the outlet-cross-section control 1*b* and the feeder 20. The control system can include a mass flow rate detector 24 responding to the mass output rate $\dot{m}_A$ and providing an instantaneous measurement thereof, the measured signal being applied to a comparator 25 to which a set-point value is applied at 26. The output of the comparator 25 adjusts the ratio mentioned previously at the classifier.

In the systems of FIGS. 1 and 1*a*, therefore, the mass rate $\dot{m}_{Fr}$ of the fresh uncomminuted product is combined with the recycled coarse material at a mass flow rate $\dot{m}_G$ to provide the input $\dot{m}_E$ to the mill. The output mass flow rate $\dot{m}_A$ feeding the elevator 2 is equal to the mass flow rate delivered to the classifier 3.

In the embodiment of FIG. 1, the rate $m_A$ is held substantially constant or the ratio $\dot{m}_G/\dot{m}_{Fe}$ according to FIG. 1*a* is held constant and a constant product fineness is thereby obtained. Adjustment of the classifier is carried out only and at most to correct for the effect of the throughput variations upon the product fineness, these throughput variations being a function of grindability and being detected at 24 to adjust the classifier as noted.

The other mills described previously may also be operated in this circulatory system.

In the embodiment of the FIG. 2, the material traverses the mill which is in a single pass so that the mass flow rate $\dot{m}_{Fr}$ of the fresh material is equal to the mass flow rate $\dot{m}_E$ of material to the mill. Naturally, the output mass flow rate $\dot{m}_A$ will be equal to the mass flow rate of the first product $\dot{m}_{Fe}$.

In this embodiment the mass flow rate detector 10 provides a signal proportional to $\dot{m}_A$ which is delivered to a comparator 12 to which a set-point value is applied at 42. The output of the comparator 12 adjusts a chute (FIGS. 3 and 4) regulating the value $\dot{m}_A$. In this embodiment therefore the quantity of the milled product per unit time leaving the mill is continuously measured and control is effected corresponding to this measurement, so that apart from small deviations the product stream mass flow rate $\dot{m}_A$ is held constant with time. The comparator 12 can receive another signal from a mass flow rate detector 11 responsive to the value $\dot{m}_E$, the two signals being compared and any difference signal applied and to adjust the rate of operation of the feeder 40.

According to the invention, the product mass flow rate $\dot{m}_A$ may be controlled in the system of FIG. 2 by recycling a portion of the milled discharge from the ball mill into a comminuting region thereof adjacent the mill outlet 1*b*. This may be achieved with the system illustrated in FIGS. 3 and 4.

Figure 3:
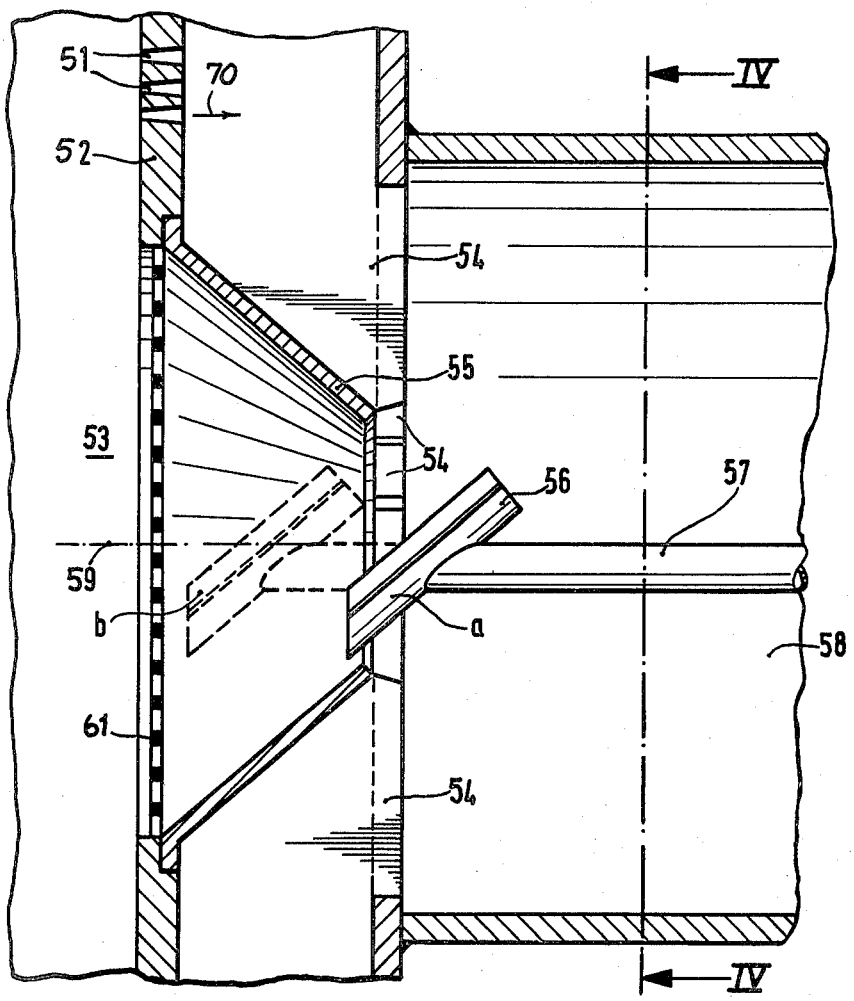
FIG. 3 is a diagrammatic axial cross section view through a ball-type tube mill at the discharge end thereof illustrating a feature of the invention.
Figure 4:
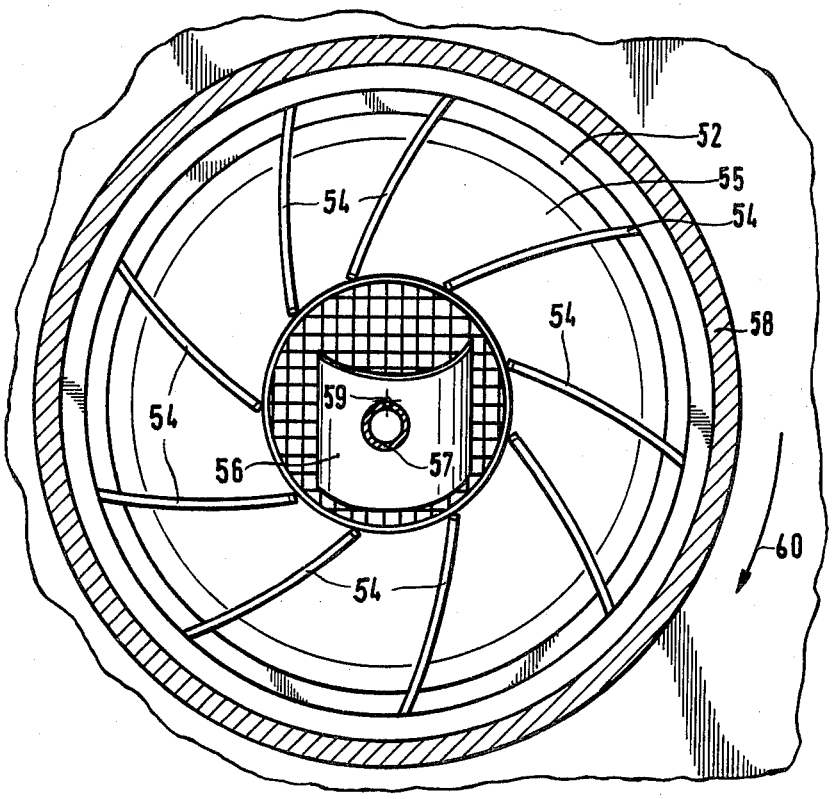
FIG. 4 is a section taken along the line IV—IV of FIG. 3.

FIG. 3 is an axial cross section schematically illustrating the central region of the mill-discharge wall (see Perry's *Chemical Engineer's Handbook*, Chapter 8, p. 21, for example). The milling chamber 53 here terminates in an end wall or grate 52 which is provided with openings 51 through which the milled product is discharged in the direction of arrow 70, thereby separating the milled product from the milling bodies.

The milled product passes through these openings onto the lifting vanes 54 which, upon rotation of the mill barrel or tube as represented by the arrow 60, lift the milled product and permits it to fall onto the frustoconical guide 55 in the discharge drum 58 of the mill. A portion of the milled product thus falls onto the downwardly inclined chute 56 which is shiftable between the positions a and b shown in solid and broken lines, respectively, by the rod 57 which can be actuated by the signal 41 from the comparator 12. In position b, the chute 56 is completely shielded and does not redirect any material into the milling chamber 53 through the grate 61 within the frustoconical member 55. The rod 57, which can be actuated by a member projecting through and out of the bearing supporting the mill, is displaceable along the axis 59 of rotation thereof. In position a the maximum quantity of milled product is returned to the milling chamber close to the discharge end while in position b all of the milling product is discharged from the drum.

I claim:

1. A method of regulating the fineness of a first product produced by a through-flow milling installation of the continuous open-circuit type wherein said milling installation includes a continuous mill having an inlet for material to be milled and an outlet for discharging said product, said method comprising the steps of measuring the mass flow rate of the milled product from said outlet and controlling said mass flow rate of said mill selectively by feedback and outlet control so that the outputted mass flow rate is substantially constant with time.

2. The improvement defined in claim 1 wherein said rate is maintained constant by controlling the rate of milled product out of said outlet and the feed of fresh material to said inlet in accordance with the detected rate.

3. The improvement defined in claim 1 wherein said rate is held constant by adjustably returning a portion of the milled product at said outlet to said mill chamber proximal to said outlet.

4. The improvement defined in claim 1 wherein said rate is continuously measured.

5. In a method regulating the fineness of a first product produced by a circulating milling installation with a ball mill having an inlet and an outlet, a classifier downstream of said mill for separating the material discharged at said outlet into a first product stream and a coarse stream, and a conveyor between said mill and said classifier, the improvement which comprises maintaining the ratio between the mass flow rate of said coarse stream and the mass flow rate of said product stream substantially constant and measuring said ratio and selectively controlling the discharge from said outlet of the mill and return of said coarse stream to said inlet of the mill to maintain the mass flow rate of the material emerging from said outlet substantially constant.

6. The improvement defined in claim 5 wherein the material to be milled is led from a feeder to said inlet and wherein said outlet of the mill and said feeder are controlled by measuring said ratio.

7. The improvement defined in claim 5 wherein said outlet of the mill is controlled by adjustably returning a portion of the milled product at said outlet to said mill chamber proximal to said outlet.

8. The improvement defined in claim 5 wherein the rate of milled product from said outlet is measured for adjusting said classifier to correct for an effect of throughput variations upon fineness of the product.

9. A continuously operating tubular or ball mill having an inlet for fresh material to be milled and an outlet for said material, the improvement which comprises means for maintaining the mass flow rate at the outlet substantially constant, said means including an adjustable chute at said outlet for recycling a variable portion of the milled product supplied to the outlet back to said mill proximal said outlet, and a mass-flow detector controlling the position of said chute.

10. The improvement defined in claim 9 wherein a milling chamber is separated from said outlet by a wall formed with a central opening and provided with perforations around said central opening whereby measured product can pass from said wall to said outlet, said wall being formed with a frustoconical apron surrounding said central opening, said mill further comprising blades for scooping milled product passing from said chamber through said wall and enabling said product to fall along said apron, said chute being disposed to intercept product deposited on said apron and being receivable and shielded therewithin in different positions of the chute.

* * * * *